United States Patent [19]

Fischman et al.

[11] 4,255,689

[45] Mar. 10, 1981

[54] CATHODE RAY TUBE WITH RESISTOR MEANS ON GLASS SUPPORT RODS

[75] Inventors: Martin Fischman; Joseph L. Hallett, both of Seneca Falls; Carl W. Penird, Waterloo, all of N.Y.

[73] Assignee: GTE Products Corporation, Stamford, Conn.

[21] Appl. No.: 30,416

[22] Filed: Apr. 16, 1979

[51] Int. Cl.[3] ..... H01J 29/88; H01J 29/96

[52] U.S. Cl. ..... 315/3; 313/479; 313/481

[58] Field of Search ..... 313/479, 481, 174, 180, 313/178; 315/3

[56] References Cited

U.S. PATENT DOCUMENTS

| | | | |
|---|---|---|---|
| 3,295,008 | 12/1966 | Gallaro et al. | 315/3 |
| 3,882,348 | 5/1975 | Paridaens | 315/3 X |
| 3,961,221 | 6/1976 | Benda et al. | 313/481 |
| 4,101,803 | 7/1978 | Retsky et al. | 313/479 X |
| 4,143,298 | 3/1979 | Bing et al. | 315/3 |

*Primary Examiner*—Palmer C. Demeo

*Attorney, Agent, or Firm*—William H. McNeill

[57] ABSTRACT

A cathode ray tube including an arc limiting resistor means (42) formed on an extension of the glass rods which align and fix the electrodes of the guns (28). The resistors also include means (54) for centering the guns in the neck of the tube.

1 Claim, 3 Drawing Figures

CATHODE RAY TUBE WITH RESISTOR MEANS ON GLASS SUPPORT RODS

TECHNICAL FIELD

This invention relates to cathode ray tubes and particularly to such tubes employing arc limiting resistors and integral electron gun centering means.

BACKGROUND ART

As the anode voltages of color cathode ray tubes have risen (currently about 30KV) and the electron guns have gotten smaller, severe problems of internal arcing during normal tube operation have occurred. In order to avoid these problems tube manufacturers have supplied an arc limiting resistor between the final anode of the electron gun and the internal conductive layer.

This arc limiting resistor can take the form of a high resistance electrical coating in the neck area of the tube, such as is shown in U.S. Pat. Nos. 4,101,803 and 3,961,221. This technique, however, necessitates the use of another resistor employed in series with the popularly used antenna getter to avoid shorting out the arc limiting resistor. This corrective procedure is also discussed in the above-cited patents.

Alternate methods of supplying an arc limiting resistor are shown in U.S. Pat. No. 3,882,348 and, U.S. Ser. No. 30,415 filed of even date herewith.

In these embodiments a separate manufactured resistor element is attached to the final anode and the internal conductive layer, adding to the cost of the gun.

DISCLOSURE OF INVENTION

Accordingly, it is an object of this invention to obviate the disadvantages of the prior art.

It is another object of the invention to enhance arc limiting cathode ray tubes.

These objects are accomplished, in one aspect of the invention, by the provision, in a cathode ray tube, of electrical resistor means connecting the final anode of the electron gun to an internal electrical conductive layer. The resistor means includes means for centering the gun in the tube and comprises a plurality of spaced apart glass rods at least one of which has a pair of spaced apart conductive coatings thereon. A resistor material fills the space between the conductive coatings. One of the conductive coatings is electrically connected to the final anode and the other is electrically connected to a conductive snubber which is in electrical contact with the internal conductive layer.

In a preferred form of the invention, the glass rods are extensions of the glass rods that hold the various electron gun elements in position.

Use of this technique provides a simple and economical form of arc limiting resistor and also reduces the number of pieces necessary to accomplish the result.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
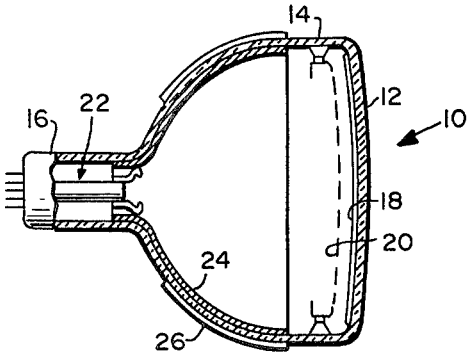
FIG. 1 is a diagrammatic sectional view of a color cathode ray tube.

Referring now to the drawings with greater particularity there is shown in FIG. 1 a more or less typical color cathode ray tube 10, having a face plate 12, body 14 and neck 16. On the inside surface of face plate 12 is a patterned cathodoluminescent screen 18 and adjacent thereto is a perforated shadow mask 20. A suitable electron source 22 is positioned in neck 16. An internal electrically conductive layer 24 is deposited on the interior surface of body 14. A conductive layer 26 also occupies specific areas on the outside of body 14.

Figure 2:
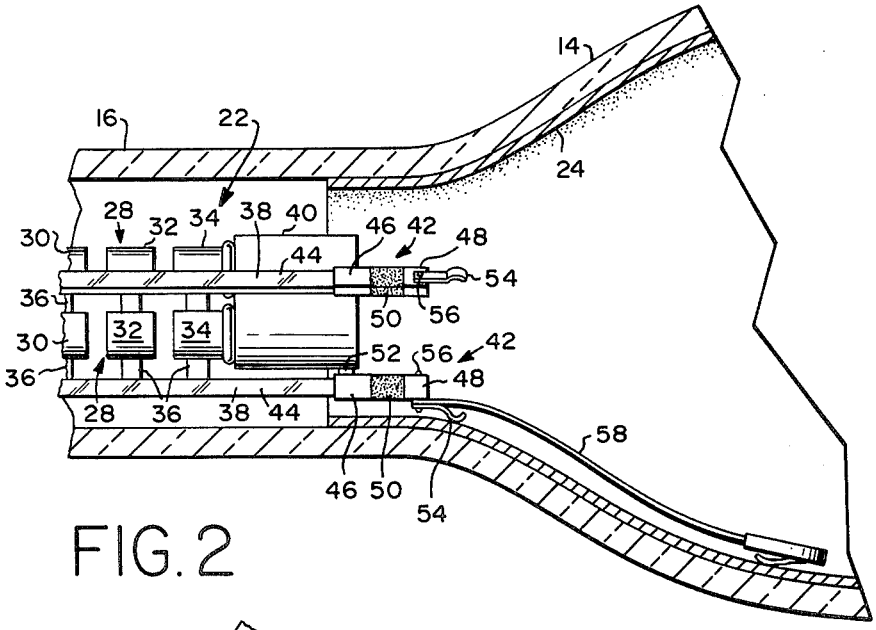
FIG. 2 is an enlarged, sectional view of the gun area of picture tube and illustrating an embodiment of the invention.
Figure 3:
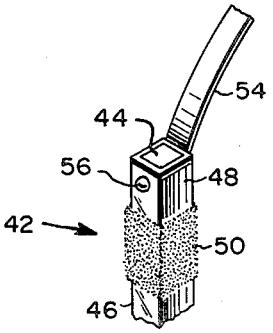
FIG. 3 is a perspective view of an arc limiting resistor in accordance with the invention.

Referring now to FIG. 2, electron source 22 is shown as comprising a plurality of electron guns 28, usually three in number, which may be arranged in delta fashion, as shown, or in a line. Each of the guns 28 is comprised of a plurality of axially aligned electrodes 30, 32, 34, or grids for performing beam focussing and acceleration.

A cathode (not shown) for each gun would also be provided. The electrodes are maintained in alignment by cooperation between studs 36 which are fixed to the electrodes and which have a free end also fixed in a glass rod (such as Pyrex) 38. At least one set of electrodes, for example 34, functions as a final anode and carries the anode voltage. A convergence cage 40 is attached to the final anodes 34 and comprises a cup shaped electrode which is common to all the anodes.

In accordance with the invention, electrical resistor means 42 are provided between the final anodes 34 and the internal conductive layer 24, which is the source of the anode voltage. The resistor means 42 are formed on an extension 44 of electrode support rods 38 and comprise a spaced pair of conductive coatings 46 and 48 having a resistor material 50, such as ruthenium based printed circuit ink manufactured by Thick Film Systems, Inc., Santa Barbara, Calif. therebetween.

One of the conductive coatings, for example 46, is connected to the convergence cage 40, for example, by means of a flexible contact 52 having one end fixed to the cage 40. The free end of rods 38 are provided with gun centering snubbers 54 which contact layer 24 and center the gun in neck 16. Snubbers 54 are attached, as by rivets 56, and are in contact with conductive coating 48. A getter wand 58 can also be attached thereto.

With this type of construction, novel arc limiting resistor means are provided which also combine a gun centering function. The extension of the glass support rods is an economical means of providing the base for these resistors.

Further, it is contemplated that only one of the extensions need be provided with the resistor 42, the other two remaining as substantially pure insulators.

While there have been shown and described what are at present considered to be the preferred embodiments of the invention, it will be apparent to those skilled in the art that various changes and modifications can be made herein without departing from the scope of the invention as defined by the appended claims.

We claim:

1. In a cathode ray tube having an evacuated envelope, an electron gun comprised of a plurality of axially aligned spaced apart electrodes including a final electrode disposed within said envelope, said electrodes being maintained in alignment by means of studs projecting therefrom being fixed in glass rods extending substantially parallel to said axis, and an internal electrically conductive layer on an interior surface of said envelope, the improvement comprising: electrical resistor means formed on extensions of said rods which project beyond said final electrode, said resistor means connecting said final anode to said internal electrically conductive layer, said resistor means including means for centering said gun in said tube and comprising on each rod a spaced pair of conductive coatings with a resistor material therebetween and connected thereto, one of each of said pairs of said conductive coatings on each rod being electrically connected to said final anode and the other one of said pairs of conductive coatings being electrically connected to a conductive snubber which is in electrical contact with said conductive layer.

* * * * *